United States Patent [19]

Magill et al.

[11] 4,244,397

[45] Jan. 13, 1981

[54] SHUT-OFF DAMPER

[75] Inventors: Robert J. Magill, Whitstable; Sydney J. Field, Ashford, both of England

[73] Assignee: Actionair Equipment Limited, Whitstable, England

[21] Appl. No.: 67,819

[22] Filed: Aug. 20, 1979

Related U.S. Application Data

[63] Continuation of Ser. No. 877,185, Feb. 13, 1978, abandoned.

[30] Foreign Application Priority Data

Apr. 29, 1977 [GB] United Kingdom ..... 18095/77

[51] Int. Cl.[3] ..... F24F 13/14

[52] U.S. Cl. ..... 137/601; 98/121 A

[58] Field of Search ..... 98/110, 121 A; 137/601; 49/91, 92; 74/467

[56] References Cited

U.S. PATENT DOCUMENTS

| | | | |
|---|---|---|---|
| 1,872,599 | 8/1932 | LeGrand | 137/601 X |
| 2,890,503 | 6/1959 | Paine | 49/91 X |
| 3,281,113 | 10/1966 | Ahern | 137/601 X |
| 3,630,098 | 12/1971 | Oxley | 74/467 X |
| 3,771,559 | 11/1973 | Alley | 137/601 |
| 3,885,347 | 5/1975 | Adachi | 98/110 X |
| 3,908,529 | 9/1975 | McCabe | 98/110 |

*Primary Examiner*—Robert G. Nilson

*Attorney, Agent, or Firm*—Berman, Aisenberg & Platt

[57] ABSTRACT

A shut-off damper having blades of a generally streamlined shape with the trailing edges of the blades comprising fluid sealing means extending along those edges so that a seal is formed between adjacent blades when the blades are in their closed positions.

12 Claims, 19 Drawing Figures

Fig. 7
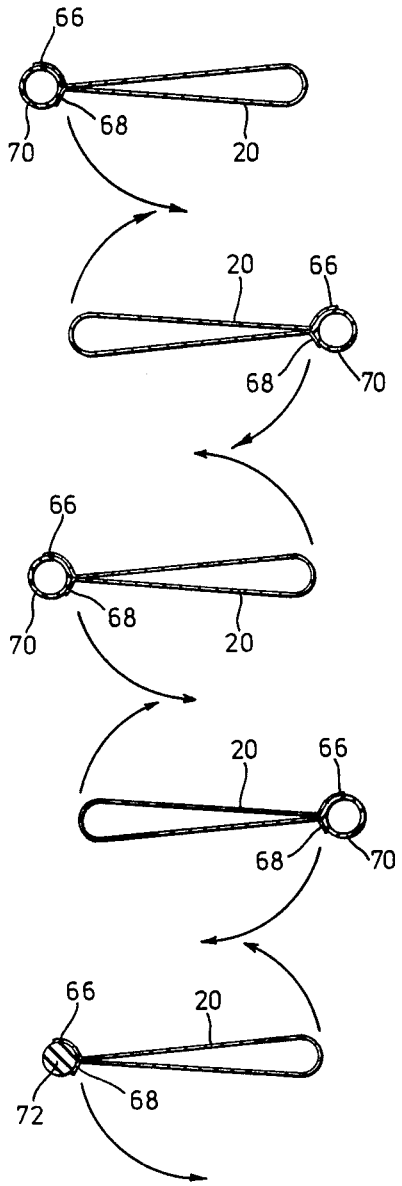
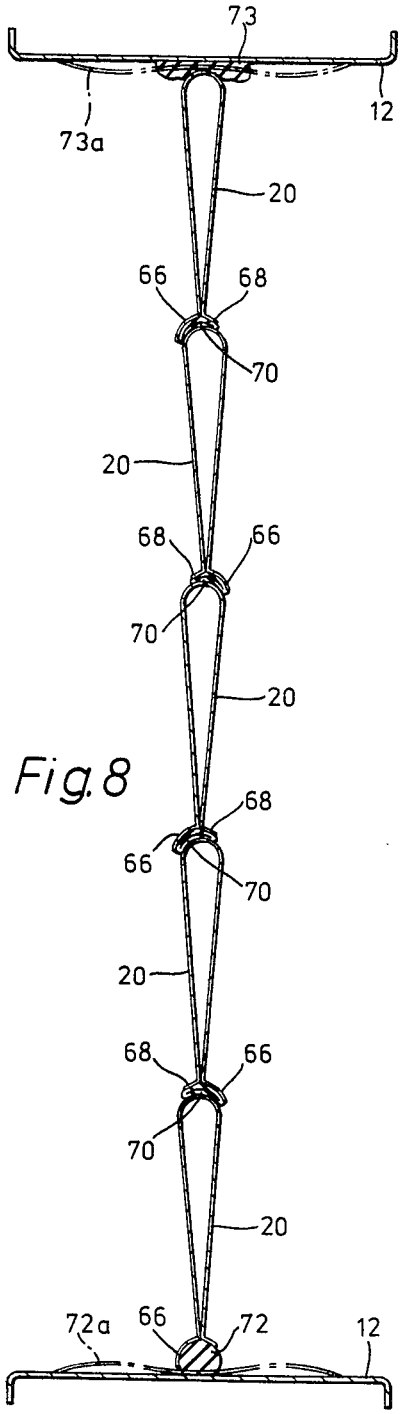
Fig. 8

SHUT-OFF DAMPER

This is a continuation of application Ser. No. 877,185, filed Feb. 13, 1978, now abandoned.

This invention relates to shut-off dampers, that is to say, dampers which are used to allow the flow of air through a duct or, in their closed position, to shut off or stop that flow completely. More specifically, the invention relates to shut-off dampers of the kind comprising a line of blades which can be swung about parallel axes to open or close an opening in a frame supporting the blades, the frame being adapted to be mounted in an air duct. The flow of air through the frame can thus be varied by varying the angle through which the blades are rotated.

In some shut-off dampers of this general construction, the blades are linked together in such a way that they all move in unison with each other and always in the same direction or sense as each other. In other shut-off dampers, the linkage between the blades is such that pairs of blades move towards and away from each other as the blades are rotated about their respective axes. In other words, adjacent blades move in opposite senses or directions to each other. The effect however in both forms of damper is the same, namely, that swinging movement of the blades about their axes moves them either towards their closed position or towards their open position.

The present invention is primarily concerned with a shut-off damper of the second type mentioned above, i.e., it has pairs of blades which move towards and away from each other. It is to be understood, however, that the invention can also be applied to the first form of construction in which the blades move always in the same direction and sense as each other.

A consideration which has influenced the design of shut-off dampers in accorance with the present invention is that the blades should have a reasonably low resistance to air flow when they are in their fully-open positions, i.e., when they lie parallel to the air flow through the frame supporting them. A further consideration is that,.in their closed positions, the blades should seal the frame against the leakage of air round the edges of the blades.

With these two considerations in mind, the present invention is directed to a shut-off damper having blades of a generally stream-lined shape with the trailing edges of the blades comprising fluid sealing means extending along those edges so that a seal is formed between adjacent blades when the blades are in their closed positions.

By means of the above proposal, leakage of air at the longitudinal edges of the blades can be reduced to a negligible amount in practice. In order to ensure that leakage does not take place at the ends of the blades, air-sealing means will normally also be provided at the ends of each blade.

Preferably the blades are of hollow construction and are produced by bending rectangular sheets of metal such as stainless steel to blade shape, the trailing edges of the blades being "opened-out" in the form of V-section fish-tail portions which are thus able to embrace the respective rounded leading edge portions of adjacent blades when the blades are in their closed positions. In this way the sealing means along the trailing edge of a blade is compressed against the leading edge of an adjacent blade. Further, the blades will normally be given a generally aerofoil shape which makes for reduced air resistance when the blades are in their fully-open positions.

The sealing means at the trailing edge of each blade can comprise a tube or solid strip of neoprene, polyvinyl chloride, or other synthetic rubbery material or foamed synthetic plastics material having a well-rounded external portion facing away from metal trailing edge of the blade.

The sealing means at the ends of the blades will usually be formed on blade bearing components which support the ends of the blades.

Some examples of shut-off dampers in accordance with the invention are shown in the accompanying drawings, in which:

FIGS. 7 and 8 are enlarged diagrammatic sectional views showing the blades in their open and closed positions respectively;

Figure 1:
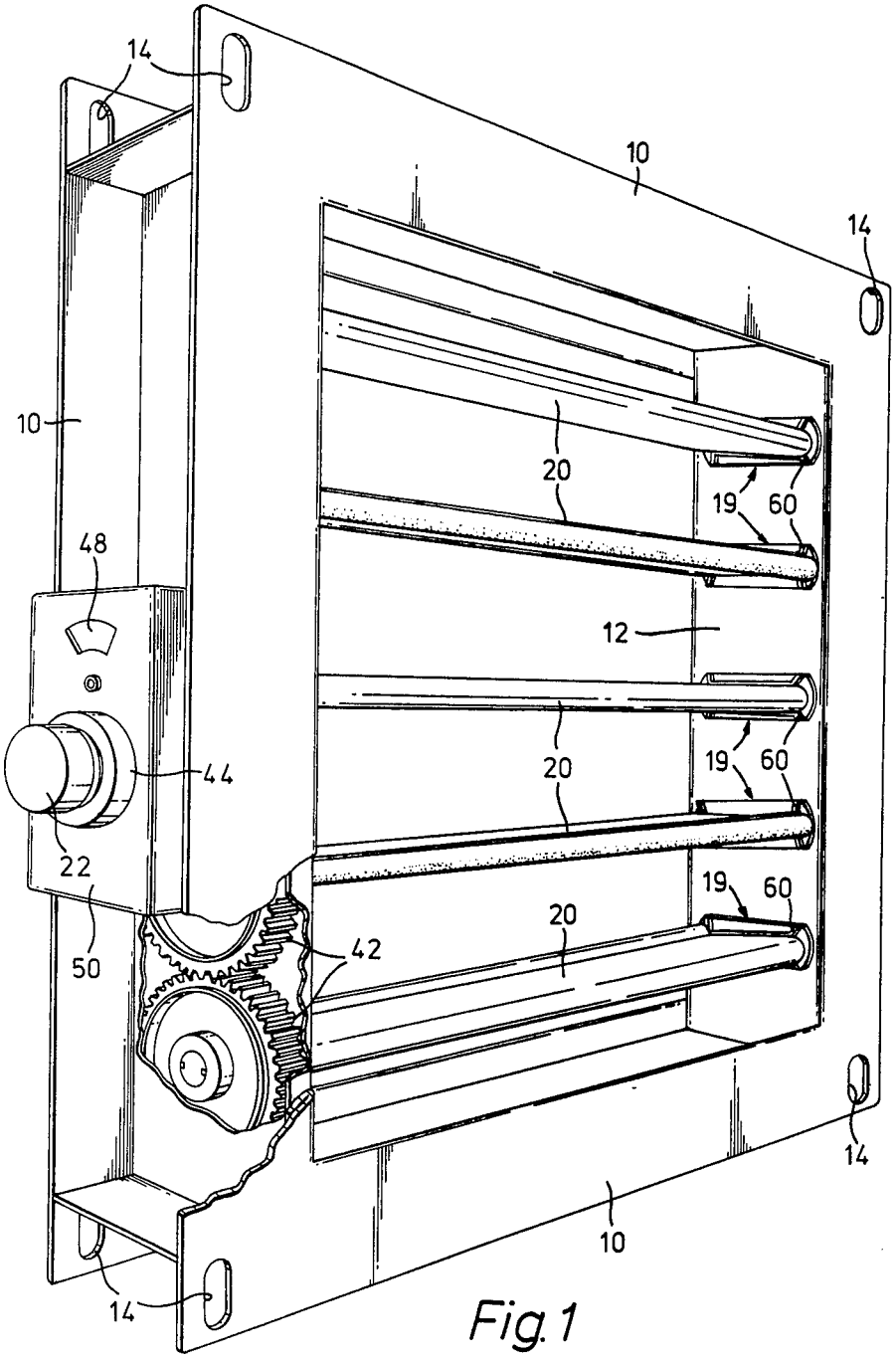
FIG. 1 is a perspective view of one form of shut-off damper with a small portion shown in section.
Figure 2:
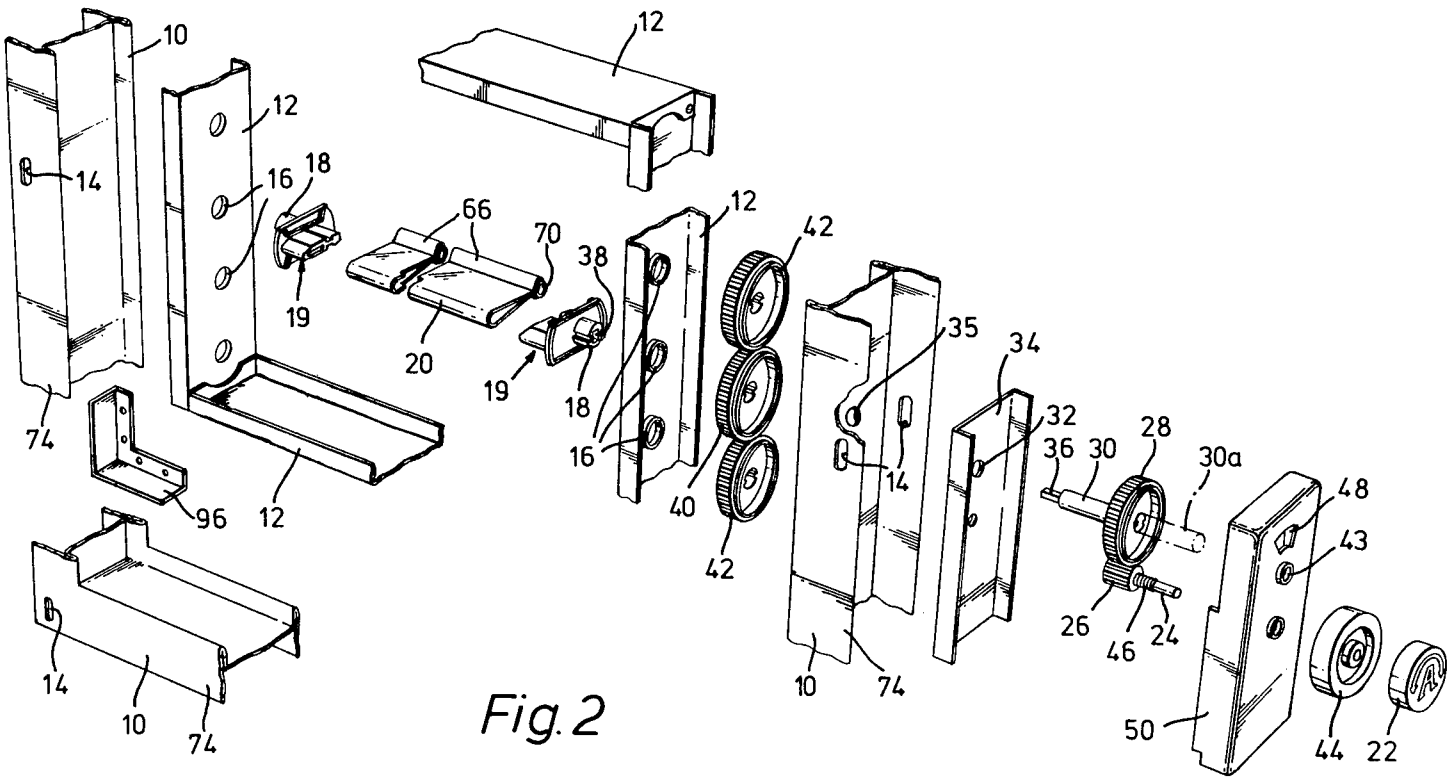
FIG. 2 is an exploded view in perspective of part of the shut-off damper shown in FIG. 1.

The shut-off damper shown in FIGS. 1 and 2 comprises a roll-formed galvanised sheet steel outer frame 10 of girder section and a sheet steel inner frame 12. The outer frame 10 has continuously-welded corners and has elongated holes 14 punched in it to permit the damper to be bolted to the flanges of an air duct and to be adjusted for height on those flanges. The attachment by welding, bolting, rivetting or other means of the inner and outer frames together produces a double-skin air-tight casing of high rigidity and substantial strength.

As will be seen from FIG. 2, the inner frame 12 has a series of holes 16 punched in its two vertical sides, the punching operation being such that the holes 16 have a length greater than the actual thickness of the metal. The holes 16 serve to support the shafts 18 of blade bearing components 19 which fit into and onto the open ends of blades 20 which are thus mounted for rotation in the frame about parallel axes. The blades 20 are low-profile aspect ratio aerofoil stainless steel blades to provide low resistance to air or other gaseous fluid flowing through the damper, especially when the blades are in their fully open positions (i.e., the portions of the blades shown in FIG. 1 of the drawings). The aerofoil section of the blades also reduces turbulence and noise and provides excellent protection against corrosion resulting from the presence of corrosive particles in the air stream. Another advantage is that the narrow blade width readily permits the withdrawal of the complete damper from a duct, regardless of the positions of the blades within the damper casing, without materially disturbing the flow of air through the duct frame as a whole.

Rotation of the blades 20 about their respective axes can be effected either manually or through power-operated means. In FIG. 2, a manually-rotated control knob 22 mounted on the outside of the outer frame 10 has a shaft 24 fixed to it, and this shaft is provided with a small gear wheel 26 meshing with a larger gear wheel 28 on a shaft 30 to provide a low-torque 4:1 rotation gear. The shaft 30 passes through a hole 32 in a base-plate 34 attached to the outer frame 10. The hole 32 is in alignment with a hole 35 in the outer frame so as to permit the keyed end 36 of the shaft 30 to enter a rectangular-section hole 38 in the shaft 18 of one of the blade bearing components 19. In so doing, the shaft 30 passes through a gear wheel 40 which is keyed on to the same shaft 18. Each blade has a respective gear wheel 42 of the same diameter and construction as the said gear wheel 40, the gear wheels 42 and the gear wheel 40 being arranged in meshing engagement and disposed in a line vertically of the damper.

By making the shaft 30 longer, as shown at 30*a*, an hydraulic, pneumatic, electric or electro-magnetic motor (not shown) may be connected to the shaft so as to turn it. Remote control of the blades then becomes possible.

It will therefore be seen that, by rotating the knob 22 to rotate the gear wheel 26 and thus the gear wheel 28, or, alternatively, by actuating a motor coupled to the shaft 30, the shaft 30 will be made to rotate the particular blade 20 to which it is connected as well as the gear wheel 40. Rotation of the gear wheel 40 will cause rotation of all the gear wheels 42 so that all the blades 20 will move together about their respective axes. However, alternate gear wheels 40, 42 will rotate in opposite senses so that adjacent pairs of blades will likewise rotate in opposite senses or directions to open or close the central passage through the damper according to which way the shaft 30 is rotated.

In order to lock the blades in a selected setting where rotation of the shaft 30 is effected manually, a cylindrical locking nut 44 is provided on the shaft 24 which carries a screwthread 46 for this purpose. A window 48 is also provided adjacent the knob 22 on the cover plate 50 so that the setting of the blades between their fully-open and their fully-closed positions can be observed. Where rotation of the shaft 30 is effected by a motor, the latter can be provided with suitable locking means to lock the shaft. Also, visual indicating means can be associated with a moving part of the motor to indicate the positions of the blades.

In order that the various gears and bearings may be quiet in operation and have high strength, low weight and long life with self-lubricating properties, the gear wheels and bearings are preferably all made of a self-lubricating synthetic plastics material such as molybdenum disulphide-impregnated nylon or polyester. Such gear wheels and bearings can be precision-moulded and are then totally enclosed and completely shut off from the air stream through the damper by the outer and inner frames 10 and 12. This ensures that the gear wheels and bearings do not become dirty or contaminated with impurities in the air stream.

Figure 3:
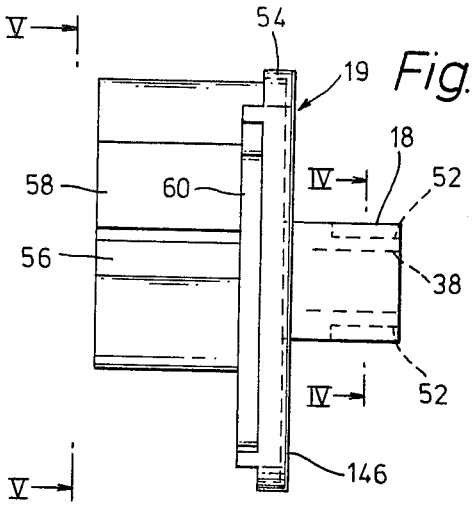
FIG. 3 is an enlarged side view of a bearing component for supporting an end of a blade.
Figure 4:
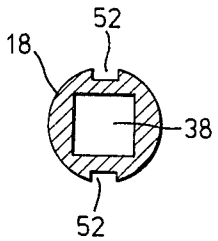
FIG. 4 is a section taken on the line IV—IV in FIG. 3.

FIGS. 3–6 illustrate the detailed construction of the blade bearing components 19 which support the ends of the blades 20. As already described above, the shaft 18 of each component 19 has a rectangular-section hole 38 so that any selected one of the components 19 can be used to receive the keyed end 36 of the shaft 30. The keying of the gear wheels 40 and 42 on their respective shafts 18 is effected by providing each shaft 18 with two longitudinally-extending external slots 52 as shown in FIGS. 3 and 4, the said gear wheels being provided with internal keys which enter those slots to lock the gear wheels against rotation on their shafts.

The shaft 18 of each component 19 leads up to an intermediate flange 54 on the component which forms a surface 56 opposing the adjacent end of its respective blade 20. Projecting from that surface 56 of the flange 54 is a spigot 58 which is specially shaped in cross-section (see FIG. 5) to enter the adjacent open end of the blade 20 and to support that end of the blade for rotation about an axis parallel to the leading and trailing edges of the blade. A pair of ridges 60 and 62 are also formed on the flange 54 of the blade bearing component to receive the extreme end-portion of the blade between them. These ridges give additional support to the blade end and also give the latter a neat appearance while having a beneficial sealing effect.

As already indicated in the introductory part of the Specification, the shut-off damper of the present invention has been devised to provide low resistance to air flow by the blades, especially when they are in their fully-open positions, and, at the same time, to ensure that there is a minimum or negligible leakage of air past the blades when they are in their fully-closed positions. In this connection, it needs to be borne in mind that shut-off dampers as used in air ducts do not generally have to cope with high pressure air but, in the great majority of cases, only with air at comparatively low pressure.

Figure 9:
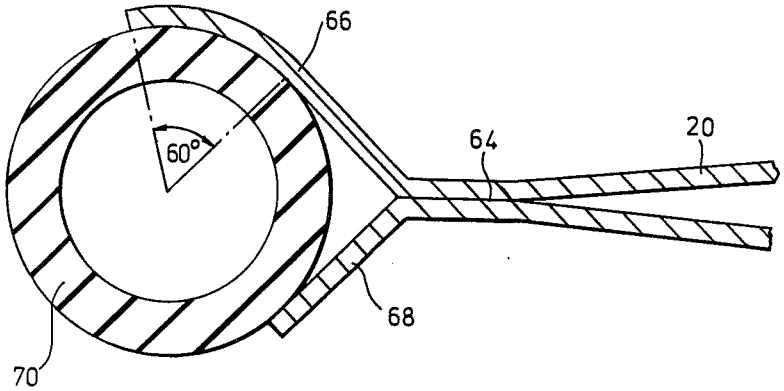
FIG. 9 is a greatly-enlarged section through the trailing edge portion of one of the blades of the damper.

To prevent leakage at the longitudinal edges of the blades, each blade 20 has fluid sealing means extending along its trailing edge so that a good seal is formed between adjacent blades when they are in their closed positions. The sealing means and the precise shape of the blade trailing edge can take various forms - as will be seen from the description of alternative constructions described below - but the preferred blade shape and sealing means is illustrated in FIGS. 7 to 9. From these figures it will be seen that, after the blade has been bent into blade-shape from a flat rectangular sheet of stainless steel, it is sealed by being welded, brazed, rivetted or otherwise connected along a zone 64 (see FIG. 9) adjacent its trailing edge. At the same time, its trailing edge portions 66 and 68 are "opened-out" to form a V-section fish tail portion which is thus adapted to embrace the respective rounded leading edge portions of adjacent blades when the latter are in their closed positions. This is illustrated in FIG. 8. It will be noted that, whereas the "turned-out" trailing edge portion 68 is entirely straight, the trailing edge portion 66 is straight for part of its total area and is then curved arcuately over the remaining part for an angular distance of 60°. This permits the trailing edge portion 68 to conform closely to the rounded leading edge of an adjacent blade when the blades are in their closed positions.

Bonded or otherwise fastened along the trailing edge of each blade is a tubular sealing member 70 as shown in FIG. 9 and the four uppermost blades in FIGS. 7 and 8. Alternatively, a solid strip 72 of sealing material as exemplified by the lowermost blade in FIGS. 7 and 8 can be used instead of the tubular sealing member 70. The sealing tube 70 or the sealing strip 72 can be made of neoprene, polyvinyl chloride, foamed synthetic plastics material, or some other rubbery or resilient sealing material. Because the sealing tube 70 or the sealing strip 72 is located partially within the V of the fish-tail portion, the tube 70 or the strip 72 will be highly compressed by the leading edge of an adjacent blade when the blades are in the positions shown in FIG. 8. By this means, leakage of air at the leading and trailing edges of the blades can be reduced, in practice, to a negligible amount.

To seal the leading edge of the uppermost blade 20, a sealing strip or tube 73 of the same material as the tube 70 or the strip 72 is bonded along the upper inner surface of the inner frame 12 as shown in FIG. 8. Alternatively, springy metal sealing strips 72*a* and 73*a* can be used in place of the sealing strips 72 and 73.

Figure 11:
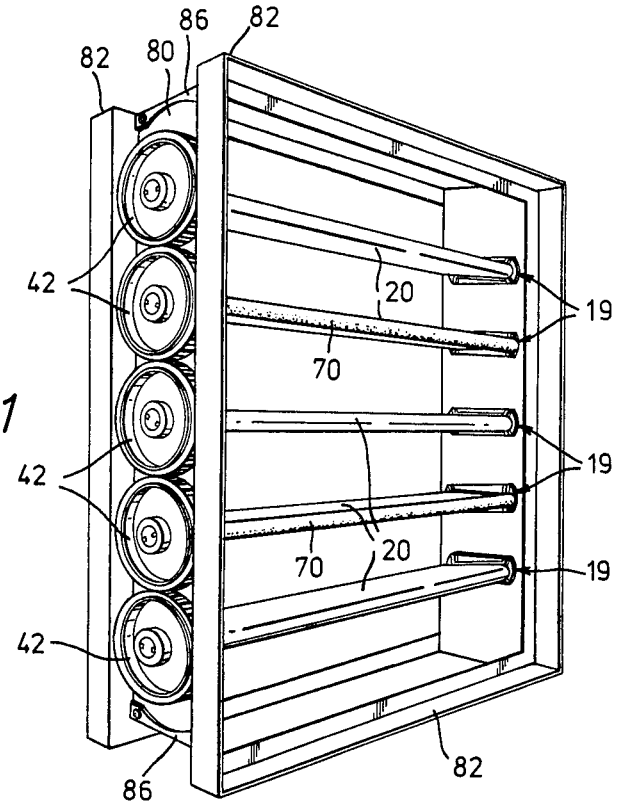
FIGS. 11, 12 and 13 are views corresponding to FIGS. 1,2 and 10 of a second form of shut-off damper.
Figure 10:
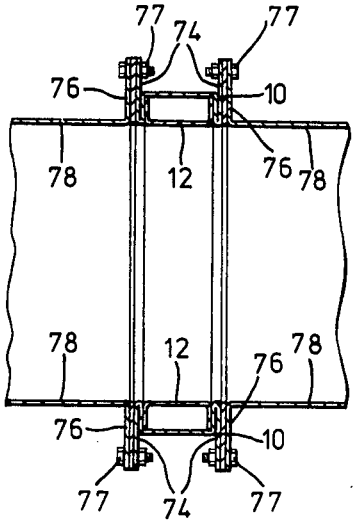
FIG. 10 is a sectional view, on a reduced scale, showing the damper of FIG. 1 mounted in an air duct.
Figure 13:
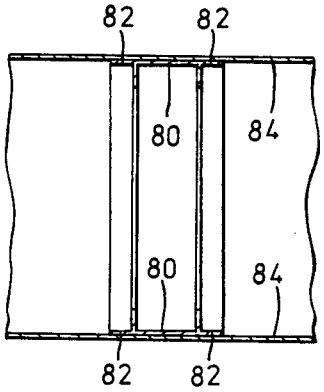
Figure 12:
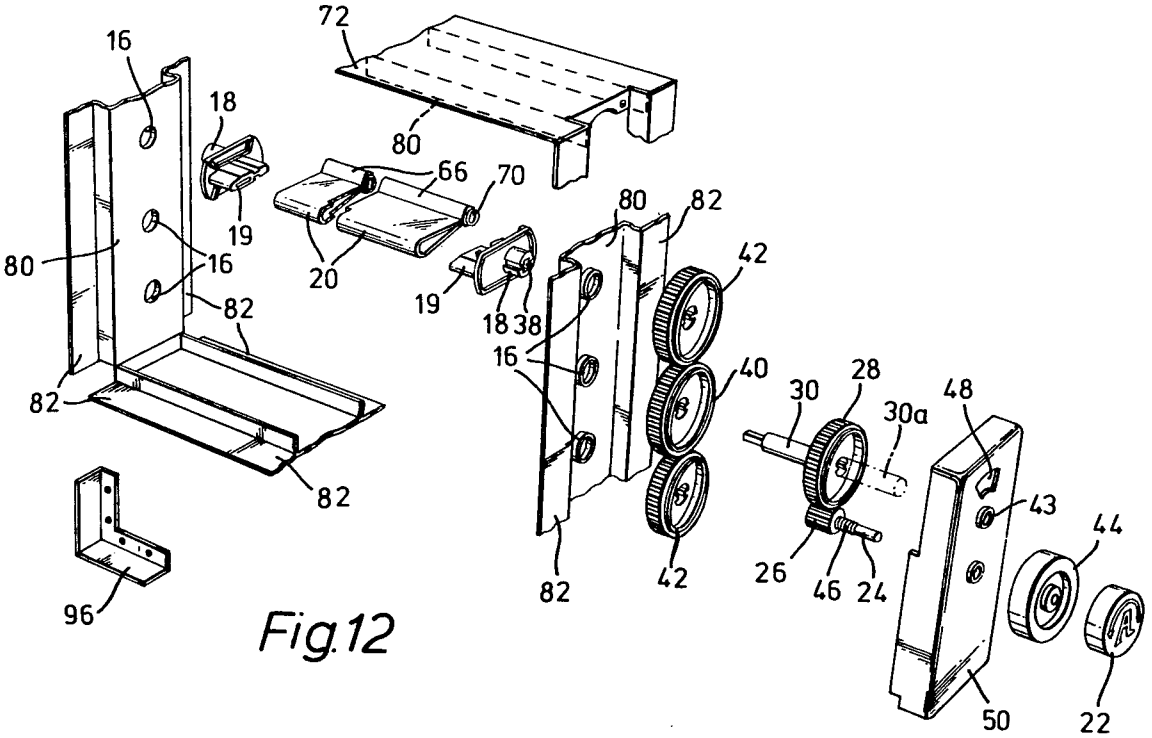

The damper illustrated in FIGS. 1–9 is designed to be inserted in a duct by having the flanges 74 of the outer casing 10 bolted to corresponding flanges 76 of the duct by bolts 77 as shown in FIG. 10. In other words, the damper is inserted in a "break" in the duct so that the inner frame 12 is substantially flush with the internal surfaces 78 of the duct. However, in certain countries—particularly the United States of America—it is customary to position dampers entirely within a duct. FIGS. 11 and 12 illustrate a damper having a frame 80 which permits this to be done. The frame 80 is, in effect, the same as the inner frame 12 in FIG. 2 except that the frame 80 has flanges 82 which lie against the inner surface 84 of a duct as shown in FIG. 13. The duct itself therefore forms an outer frame for the damper so that the outer frame 10 of FIG. 1 is no longer needed. Apart from this and the omission of the base-plate 34 shown in FIG. 2, the damper shown in FIGS. 11 and 12 is essentially the same as that shown in FIGS. 1–9, and the same reference numerals have been applied to like parts.

Figure 14:
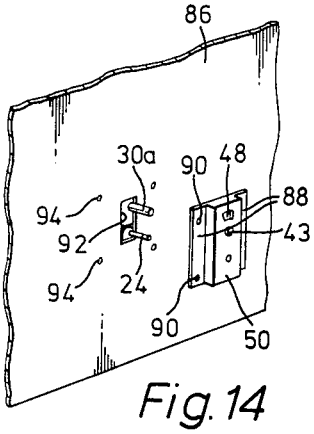
FIG. 14 is a perspective view illustrating a modification to the damper of FIGS. 11 and 12.

FIG. 14 illustrates a small modification to the damper shown in FIGS. 11 and 12 in that the cover plate 50 is designed to be screwed or bolted to the inside or outside of a duct 86, the cover plate having a pair of flanges 88 with bolt or screw holes 90 in it to permit this to be done. A small window 92 is cut in the wall of the duct 86 to allow the shafts 24 and/or 30*a* to project through that wall and thus enter the cover plate 50. Screw or bolt holes 94 are also provided in the duct wall to match the holes 90 in the flanges 88.

In order to strengthen the inner frame 12 of FIG. 2 and the frame 80 of FIGS. 12 and 13, L-shaped metal corner pieces 96 are welded, rivetted or otherwise fixed to the corners of those frames.

FIGS. 15 to 19 illustrate alternative forms of blade 20 and alternative trailing edge sealing means in accordance with the invention, and these will now be described.

Figure 15:
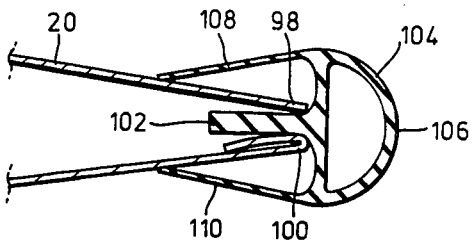
FIGS. 15–19 illustrate five further alternative forms of sealing means provided on the trailing edges of blades.

In FIG. 15, the trailing edge of the blade 20 is formed by the two edge portions 98 and 100, the edge portion 100 being formed by doubling over the extreme edge of the blade. The two edge portions 98 and 100 nip between them a root portion 102 of a sealing strip 104 formed of neoprene or other rubbery sealing material. The said sealing strip has a well-rounded external surface 106 which faces away from the metal trailing edge of the blade, and from this surface 106 there extends two webs 108 and 110, one on each side of the blade, so as to provide a smooth stream-lined surface with the metal portion of the blade 20.

Figure 16:
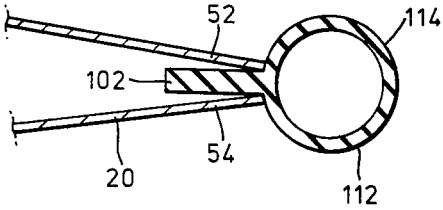

The sealing strip shown at 112 in FIG. 16 has a stem 102 like that shown in FIG. 15 but is here formed with a circular-section portion 114. This construction is not therefore so stream-lined as the sealing strip shown in FIG. 15 with its lateral webs 108 and 110.

Figure 17:
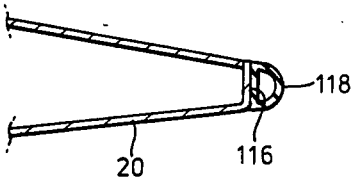

FIG. 17 illustrates another alternative in which the metal portion of the blade 20 is formed with a flat trailing edge face 116 which has, bonded to it, the flat face of a D-section hollow sealing strip 118.

Figure 18:
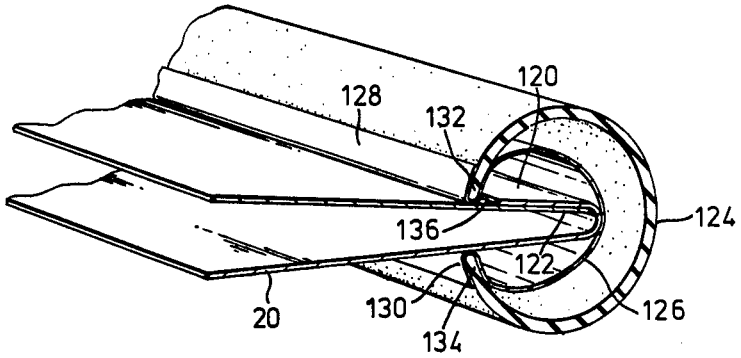

FIG. 18 shows a blade 20 having an edge portion 120 which is bent over so as to lie flat against the outer surface of the edge portion 122, the two overlapping portions being spot welded at regular points along the length of the blade. The sealing means at the trailing edge of the blade comprise a strip 124 of flexible neoprene or other rubbery sealing material which has been folded over in a C-shape and removably held on the trailing edge portion of the metal blade 20 by a C-section springy metal clip 126. The longitudinal edges of this clip 126 are bent back at 128 and 130 so as to nip the longitudinal edge portions 132 and 134 of the sealing strip.

It has been found that the existence of the small shoulder 136 formed by the turned-over edge portion 120 of the metal blade is sufficient to prevent the clip 126 from coming off the blade. Naturally, the spring clip 126 will have sufficient resilience to grip the blade quite strongly.

Figure 19:
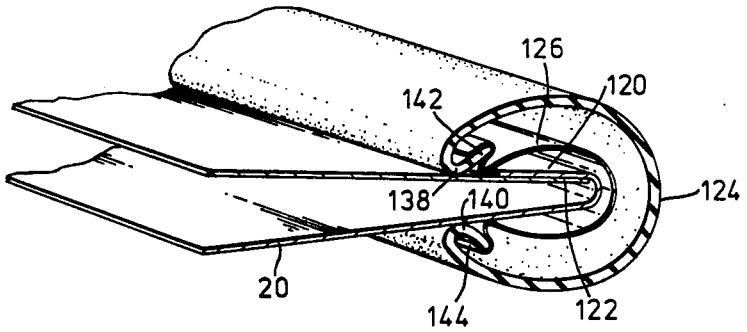

Yet another alternative construction is shown in FIG. 19. In this case, the sealing strip 124 has its longitudinal edge portions 138 and 140 folded underneath the longitudinal edge portions 142 and 144 of the spring clip 126. A further difference is that the said edge portions of the spring clip 126 are located inwardly of the strip 124 and not externally of it as in FIG. 18.

Figure 5:
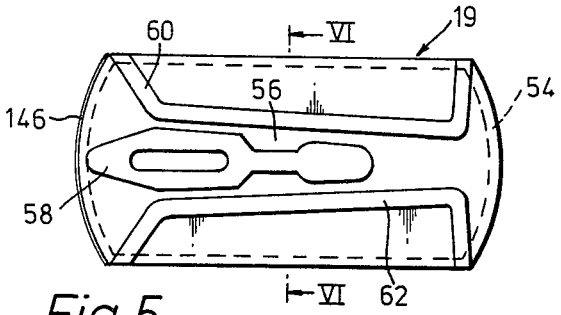
FIG. 5 is an end view of the bearing component as seen from the line V—V in FIG. 3.
Figure 6:
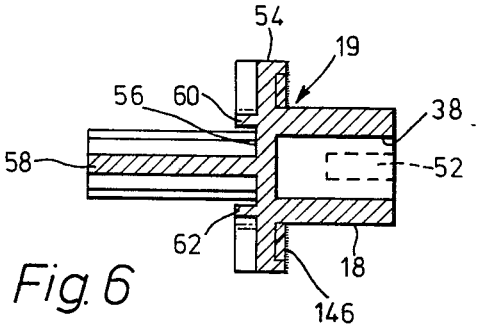
FIG. 6 is a section taken on the line VI—VI in FIG. 5.

In order that air may not leak round the ends of the blades when they are in their fully-closed positions, sealing strips or pads 146 made of felt or other sealing material are provided on the blade bearing components as shown in FIGS. 3, 5 and 6.

The extent to which the blades can be rotated about their respective axes can be varied to suit the requirements of different customers. Normally they will be rotatable through 90° to provide for maximum flexibility in use.

We claim:

1. A shut-off damper for shutting-off the flow of gaseous fluid through a duct, said damper comprising: a hollow metal frame defining an opening for the passage of fluid therethrough, a line of hollow, sheet-steel, aerofoil-section, opened-ended blades arranged in said opening of said frame with each blade having a leading edge and a trailing edge, a plurality of blade bearing components, one at each end of each blade, to support the blades on said frame for rotation about parallel axes extending longitudinally of the blades, said blades being swingable about said axes to open and close the said opening in the frame, a shaft on each blade bearing component and a respective aperture in said frame to rotatably receive said shaft, an intermediate flange on each blade bearing component, a surface on said flange opposing the adjacent open end of the respective blade, a spigot prejecting from said flange surface and shaped in cross-section to enter the said adjacent open end of the blade and to support that end of the blade for rotation about the longitudinal axis of the blade, a pair of spaced-apart flange-like ridges projecting from said flange surface of said blade bearing component to snugly receive the extreme end-portion of the blade between them, the ridges being in sealing contact with said extreme end portion to give additional support to the blade end and to provide a seal at the blade end, a plurality of rotary elements, one for each blade, keyed onto the blade bearing components at one side of said frame for the purpose of effecting swinging movement of the blades about their parallel axes, the said rotary elements being rotatable in unison to cause corresponding swinging movement of the blades between their fully-open and fully-closed positions, and fluid sealing means extending along the trailing edge of each blade whereby a seal is formed between adjacent blades when the blades are in their closed positions, said trailing edge sealing means comprising a compressible sealing member fastened to the trailing edge of the respective blade, there also being additional fluid sealing means interposed between the flange on each blade bearing component and the said frame.

2. A shut-off damper according to claim 1, wherein the blade bearing components are made of a self-lubricating synthetic plastics material.

3. A shut-off damper according to claim 1, wherein said additional sealing means are carried on the blade bearing components.

4. A shut-off damper according to claim 1, wherein locking means are provided on the damper to lock the blades in a selected setting.

5. A shut-off damper according to claim 1, wherein the frame has flanges adapted to lie against the inner surface of a duct after the damper has been positioned entirely within the duct.

6. A shut-off damper according to claim 1, wherein said additional sealing means are in the form of sealing strips.

7. A shut-off damper for shutting -off the flow of gaseous fluid through a duct, said damper comprising: a hollow metal frame defining an opening for the passage of fluid therethrough, a line of hollow, sheet-steel, aerofoil-section, open-ended blades arranged in said opening of said frame with each blade having a leading edge and a trailing edge, a plurality of blade bearing components, one at each end of each blade, to support the blades on said frames for rotation about parallel axes extending longitudinally to the blades, said blades being swingable about said axes to open and close the said opening in the frame, a shaft on each blade bearing component and a respective aperture in said frame to rotatably receive said shaft, an intermediate flange on each blade bearing component, a surface on said flange opposing the adjacent open end of the respective blade, a pair of spaced-apart flange-like ridges projecting from said flange surface of said blade bearing component to snugly receive the extreme end-portion of the blade between them, the ridges being in sealing contact with said extreme end-portion to provide a seal at the blade end, a plurality of rotary elements, one for each blade, keyed onto the blade bearing components at one side of said frame for the purpose of effecting swinging movement of the blades about their parallel axes, the said rotary elements being rotatable in unison to cause corresponding swinging movement of the blades between their fully-open and fully-closed positions, and fluid sealing means extending along the trailing edge of each blade whereby a seal is formed between adjacent blades when the blades are in their closed positions, said trailing edge sealing means comprising a compressible sealing member fastened to the trailing edge of the respective blade, there also being additional fluid sealing means interposed between the flange on each blade bearing component and the said frame.

8. A shut-off damper according to claim 7, wherein the blade bearing components are made of a self-lubricating synthetic plastics material.

9. A shut-off damper according to claim 7, wherein said additional sealing means are carried on the blade bearing components.

10. A shut-off damper according to claim 7, wherein locking means are provided on the damper to lock the blades in a selected setting.

11. A shut-off damper according to claim 7, wherein the frame has flanges adapted to lie against the inner surface of a duct after the damper has been positioned entirely within the duct.

12. A shut-off damper according to claim 7, wherein said additional sealing means are in the form of sealing strips.

* * * * *